US006736475B2

(12) United States Patent
Youngberg et al.

(10) Patent No.: US 6,736,475 B2
(45) Date of Patent: May 18, 2004

(54) METHOD FOR PROVIDING ANGULAR POSITION INFORMATION FOR A RADIAL PRINTING SYSTEM

(75) Inventors: Carl E. Youngberg, Mapleton, UT (US); George L. Bradshaw, Palo Alto, CA (US); Randy Q. Jones, Sunnyvale, CA (US)

(73) Assignee: Elesys, Inc., Sunnyvale, CA (US)

( * ) Notice: Subject to any disclaimer, the term of this patent is extended or adjusted under 35 U.S.C. 154(b) by 0 days.

(21) Appl. No.: 09/815,064

(22) Filed: Mar. 21, 2001

(65) Prior Publication Data

US 2002/0030705 A1 Mar. 14, 2002

Related U.S. Application Data

(60) Provisional application No. 60/191,317, filed on Mar. 21, 2000.

(51) Int. Cl.[7] ..... B41J 3/00

(52) U.S. Cl. ..... 347/2; 347/5; 347/9

(58) Field of Search ..... 347/9, 25; 346/139, 346/137; 101/35, 38.1; 386/126; 156/387; 400/70; 369/275.1, 52

(56) References Cited

U.S. PATENT DOCUMENTS 5,717,679 A * 2/1998 Mashimo et al. ..... 369/124
6,285,762 B1 * 9/2001 Gotoh et al. ..... 308/203

FOREIGN PATENT DOCUMENTS

GB 2320912 A * 8/1998

* cited by examiner

*Primary Examiner*—Hai Pham
*Assistant Examiner*—Lam Nguyen
(74) *Attorney, Agent, or Firm*—Beyer Weaver & Thomas LLP.

(57) ABSTRACT

Disclosed is a method for detecting an angular position of a rotating media having a native wobble signal. Prior to recording data on the rotating media, timing information is obtained from the native wobble signal in the rotating media over a substantial portion of a prerecorded media area of the rotating media. An angular position of the rotating media is determined from the timing information. The determined angular position is used to accurately print an image onto the rotating media.

12 Claims, 7 Drawing Sheets

METHOD FOR PROVIDING ANGULAR POSITION INFORMATION FOR A RADIAL PRINTING SYSTEM

CROSS REFERENCE TO RELATED APPLICATIONS

This application claims priority to U.S. Provisional Patent Application, having application No. 60/191,317, filed Mar. 21, 2000, entitled "A Method for Providing Angular Position Information for a Radial Printing System" by Carl E. Youngberg, et al, which application is incorporated herein by reference in its entirety for all purposes. This application is also related to co-pending U.S. patent application, having application Ser. No. 09/062,300, filed Apr. 17, 1998, entitled "Radial Printing System and Methods" by George L. Bradshaw et al, which application is incorporated herein by reference in its entirety for all purposes.

REFERENCE MATERIALS

CD Standard Specifications (Orange), The Orange Book, (A set of documents describing the Recordable Compact Disc Systems) Part II, Philips Electronics N.V., http://www.licensing.philips.com/cdsystems/cdstand specorange.html CD-ROM Professional's CD-Recordable Handbook, Dana J. parker and Robert A. Starrett, 1996, Pemberton Press, Wilton Conn., ISBN 0-910965-18-8

The Compact Disk Handbook, $2^{nd}$ Edition, Ken C. Pohlmann, 1992, A-R Editions, Madison, Wis., ISBN 0-89579-300-8

BACKGROUND OF THE INVENTION

The present invention relates to printing systems and methods for printing with the same. More particularly, the present invention relates to printing systems with a plurality of ink jet cartridges that are configured to radially print directly on to the top surface of a circular media that is inserted into a CD drive mechanism, while the CD drive mechanism rotates the media in relation to a printing assembly.

In the art of dispensing fluidic ink objects as it applies to radial printing, there is a need to place ink objects accurately and precisely onto the spinning circular media to effectively use the mechanisms of radial printing. In a radial printing application, ink is placed onto a circular media as it is rotating. To properly place the ink, the mechanisms governing the print process must have as one of it's inputs information relating to the instantaneous position of the disk with respect to the print engine emitting the ink. That information over a period of time translates to instantaneous angular position and velocity, which affects other aspects of radial printing such as pen firing frequency. Thus, in any radial printing system, a mechanism must be employed to provide the electronics governing the printing process with the information regarding the instantaneous position of the rotating media or disk.

Accordingly, there is a need for mechanisms for providing an instantaneous angular position of a rotating media for use in printing onto such rotating media.

SUMMARY OF THE INVENTION

The present invention relates to information circular recording media, such as an optical disc like CD recordable media (CD-R). For the scope of this invention, the terms "CD-R" and "CD" are intended to mean all varieties of recordable media (e.g., CD and DVD).

More particularly, this invention uses a variety of methods to determine the instantaneous angular position of a spinning and typically circular recordable CD-R media to enable radial printing. This includes: using prerecorded timing information from the native wobble signal in pregrooved CD-R recordable disc media over the entire prerecorded disc area; using the timing-code information in the data track of an already recorded CD-R disc; or using an entirely independent encoding pattern pre-placed during manufacturing directly on the inner hub or outer circumference edge of the CD-R media coupled with an external encoder sensor. These signals are uniquely combined with a radial printing system to form a synchronized system for printing a label on the top surface of the recordable disc media while the disc is spinning, independent of recording, during recording or during playback.

The CD Standard Specifications Orange Book specifies in detail how CD-R media are to be pregrooved for use, which is well known in to those skilled in the art. Timing markings along a pre-grooved spiral track contains a wobble signal. This wobble signal provides CD laser head servo tracking alignment and clocking information to control disc spin rate. The native wobble is present throughout the prerecorded CD-R disc media, including the prerecorded track in the Power Calibration Area (PCA), the Program Memory Area (PDA), lead-in, data programming, or lead out areas. Alternately this invention uses the timing-code information in the post-recorded data area of the CD-R media.

The present invention uses several methods for sensing the angular position of rotating or spinning CD-R media to be utilized in a radial printing system. FIG. 2 is a diagrammatic representation of an example radial printing system in which the present invention may be implemented. As shown, the printing head assembly 210 is placed radially over the spinning CD disc 214. The synchronization system 204 uses signals from the CD servo 206 to sense the disc 220 (platter 201) spin rate or control the motor 208. Several embodiments of a radial printing system are described in the above referenced co-pending U.S. patent application by Bradshaw et al, which is incorporated by reference. Radial printing can be optionally performed on spinning media, even while actual CD recording is in process. As such, a radial printing system preferably determines the instantaneous angular velocity and position of rotating CD-R media to be able to print radially.

The present invention uses these signals on CD-R media in a unique way to provide angular position information for radially printing a label on the top surface of the CD-R media while it spins.

BRIEF DESCRIPTION OF THE DRAWINGS

The invention, together with further advantages thereof, may best be understood by reference to the following description taken in conjunction with the accompanying drawings.

BEST MODE FOR CARRYING OUT THE INVENTION

To determine the instantaneous angular velocity and rate of disc spin specifically for radial printing, the radial printing system synchronizes with the spinning disc media and/or the CD-R device control system. To do this, this invention uniquely uses signals from among the following: (1) the inherent pregrooved wobble frequency signal in the unrecorded track of a new CD-R disc, (2) the timing-code information in the data track of an already recorded CD-R disc, or (3) an entirely independent encoding pattern preplaced during manufacturing directly on the inner hub or outer circumference edge of the CD-R media.

Figure 1:
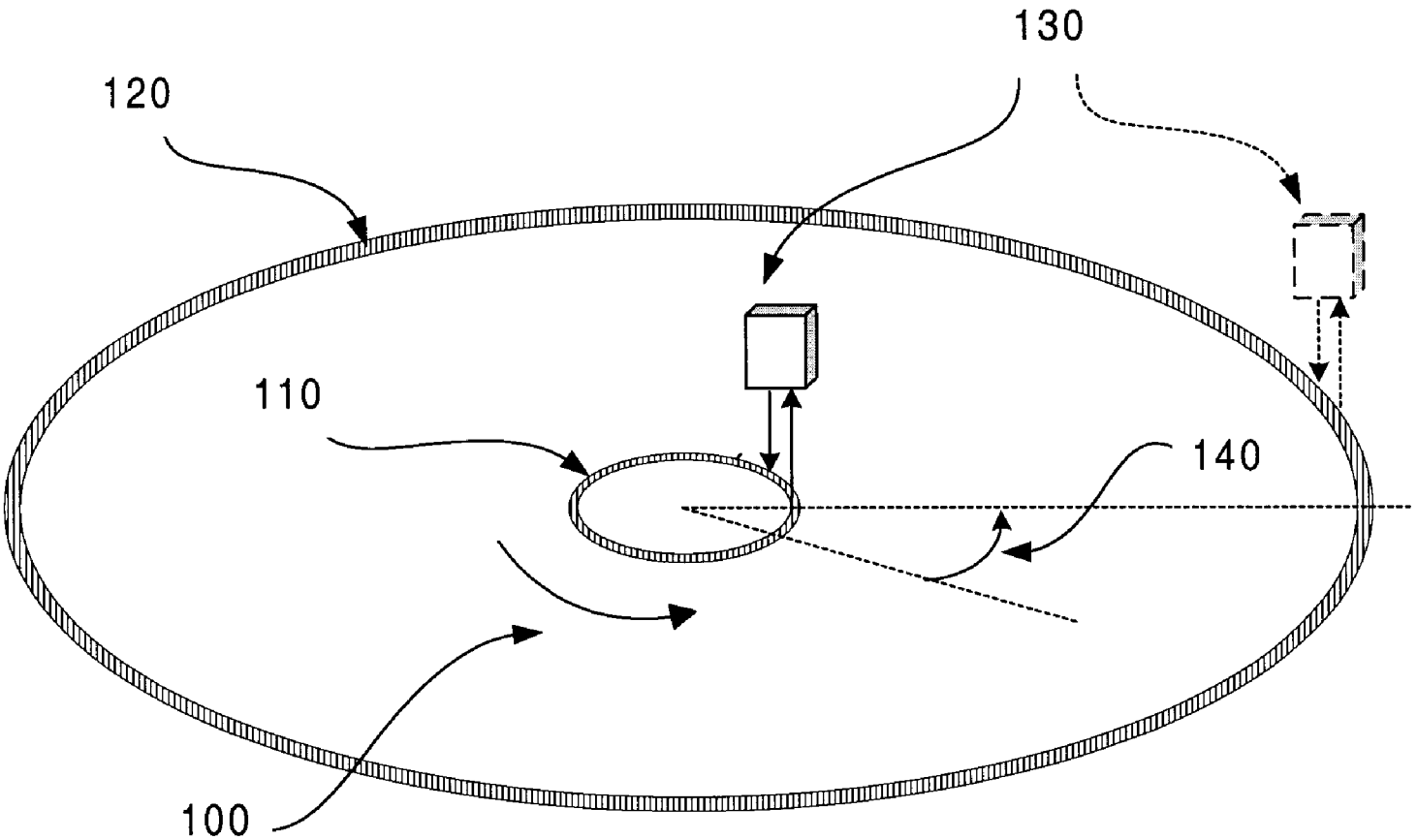
FIG. 1 is a diagrammatic representation of a CD-R recordable media.
Figure 2:
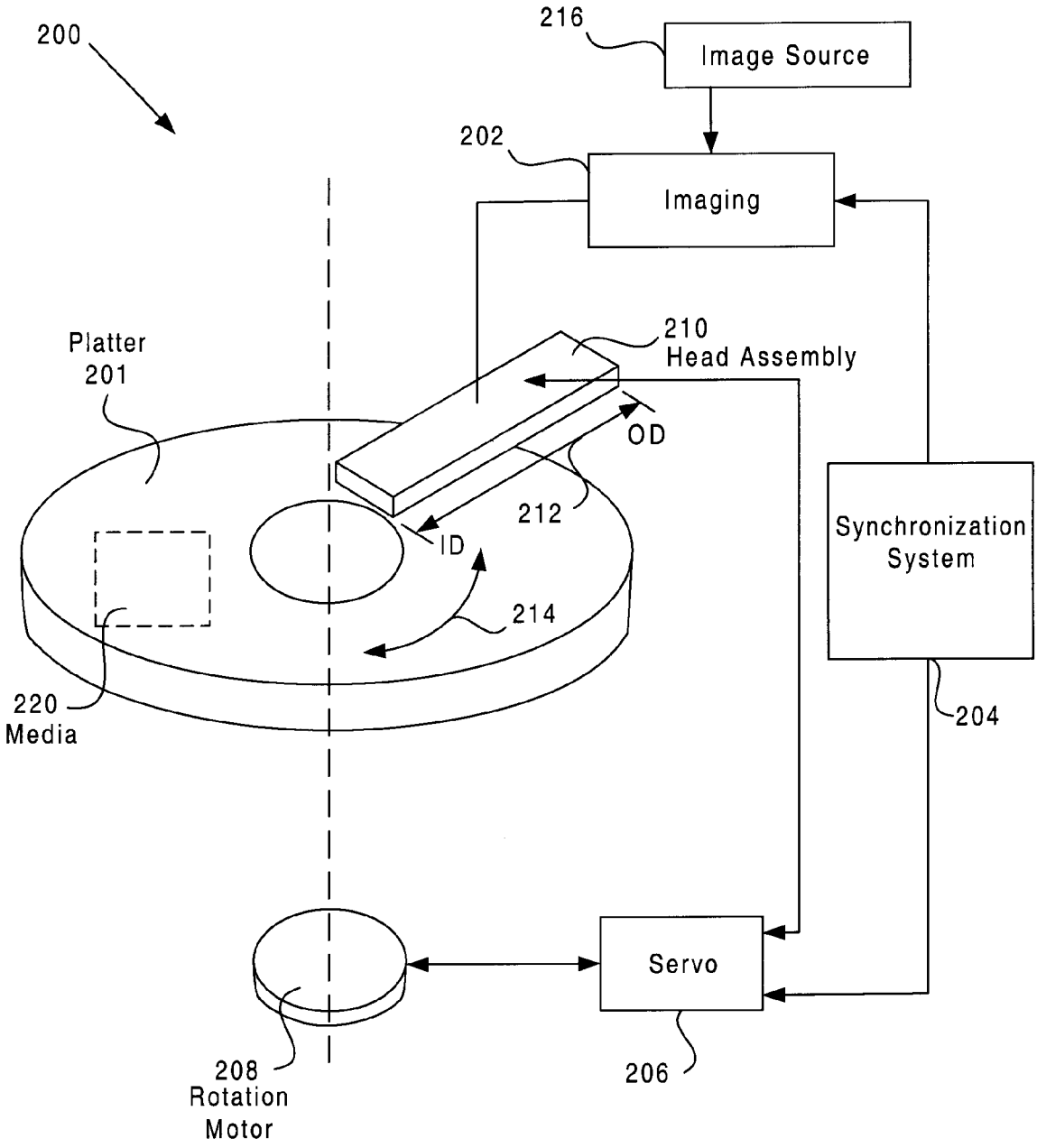
FIG. 2 is a diagrammatic representation of an example radial printing system in which the present invention may be implemented.
Figure 3:
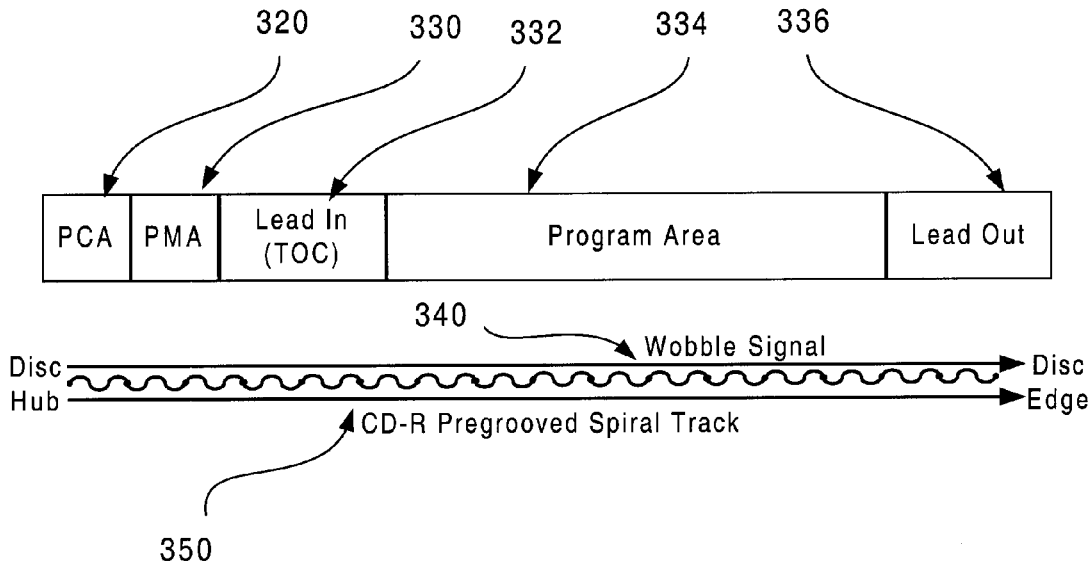
FIG. 3 illustrates a pre-groove spiral track wobble frequency signal inherent in all CD-R recordable media, which wobble signal may be used to determine the instantaneous angular position of such CD-R recordable media in accordance with a first embodiment of the present invention.
Figure 6:
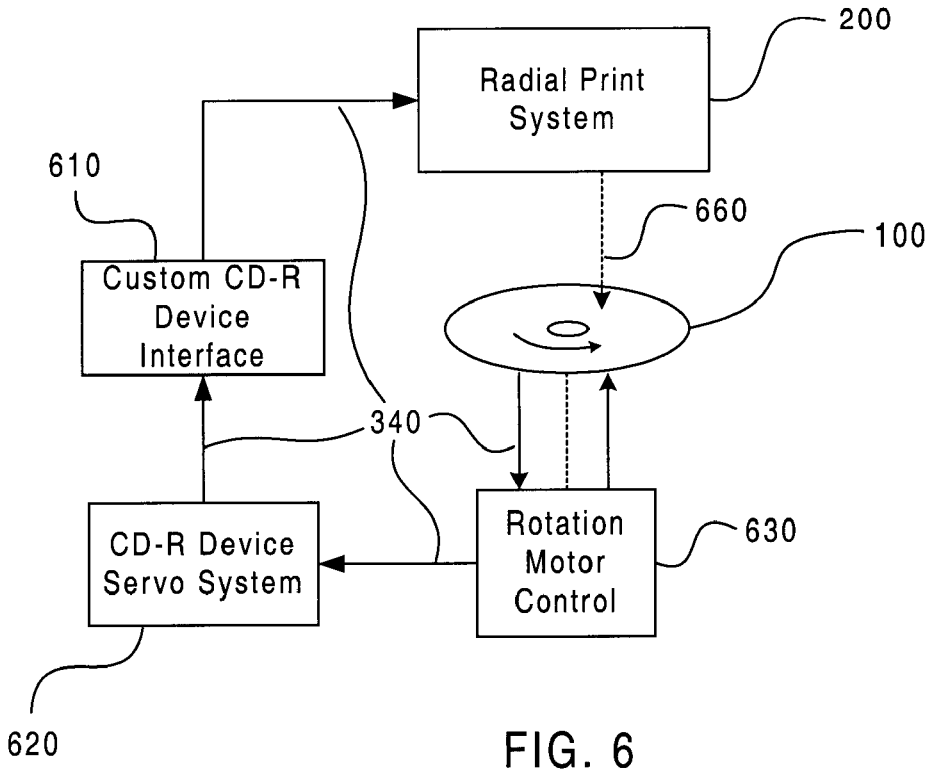
FIG. 6 is a diagrammatic illustration of a CD-R/printing system which utilizes the wobble signal or a derivation of the wobble signal to print onto a spinning media in accordance with an example implementation of the first embodiment of the present invention.

In the first embodiment, the present invention uses the pre-groove spiral track 350 wobble frequency signal 340 illustrated in FIG. 3 inherent in all CD-R recordable media to determine the instantaneous angular position 140 of a spinning circular media 100 shown in FIG. 1, to enable precise placement of ink in the application of radial printing shown in FIG. 2, such as with an ink jet print head 210. While this signal 340 is used primarily for alignment and tracking of the CD-R laser for reading and recording shown in FIG. 6, 620, it can also be used to determine the angular position 140 (FIG. 1) of the spinning media at any given time during rotation and thus provide a high degree of printing accuracy. Since these timing signals are only available while the CD-R media is spinning, preferably they are carefully synchronized with the CD writer device control system. For example, the CD-R recording software is preferably tightly coupled and synchronized with the software that controls the printing to ensure that the printing process proceeds without interfering with the recording process. Likewise, since the CD motor 630 must be spun an adequate number of revolutions to complete the printing process, it may be necessary to activate the CD-R motor 630 to finish the printing task. The advantage of this method is to provide accurate angular print information without the need for additional components, such as an eternal encoder and codewheel, since it uses standard CD-R media for all timing information. For example, an all-in-one device to record discs and print labels on encoder-pattern-grating CD/DVD media may be designed for lower overall manufacturing cost or allow smaller size of the device, because an external encoder or grating is unnecessary.

Figure 4:
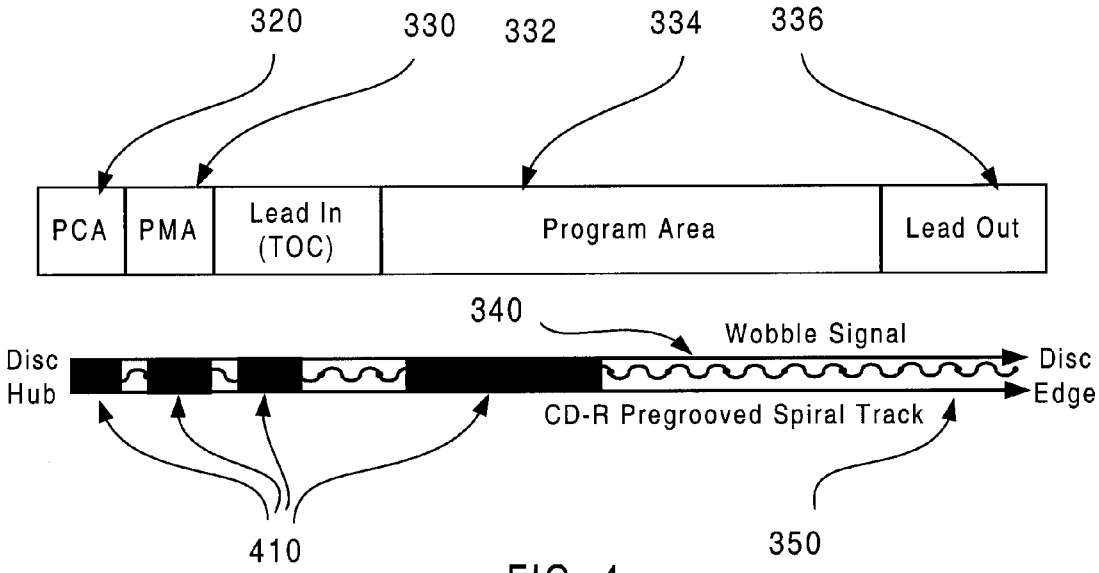
FIG. 4 illustrates the wobble frequency signal and the timing code information inherent within the data track of a partially or fully recorded CD-R recordable media, which signals may be used together or separately to determine the instantaneous angular position of such CD-R recordable media in accordance with a second embodiment of the present invention.

In a second embodiment, similar to the first, the same considerations are necessary for printing on CD-R media; however, the disc media may contain partially completed recording information. This is illustrated in FIG. 4 in contrast to FIG. 3. In FIG. 4, the timing signals used to determine the angular position 140 of the spinning media 100 are derived instead from or a combination of the timing-code information in the data track 410 of an already- or partially recorded CD-R disc. In the later case of a partially recorded disc, such as a Multisession disc, the timing information 410 is derived by combining timing-code information in the data track of the already recorded area, on the one hand, with the pre-groove wobble frequency signal 340 inherent in remaining unrecorded media, on the other hand; these are used in concert to determine the instantaneous angular position 140 of a spinning circular media 100. Similar to the first method, the advantage of this method is to provide accurate angular print information without the need for additional components since it uses standard CD-R media for all timing information.

Figure 5:
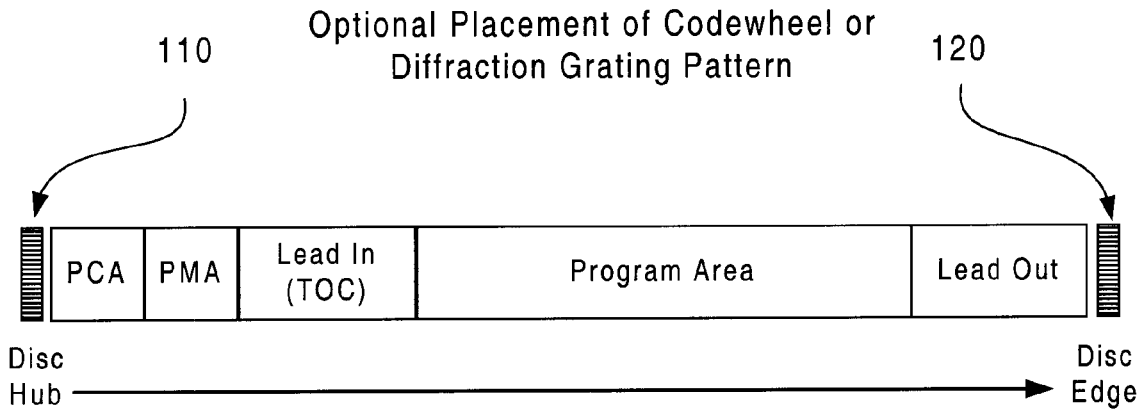
FIG. 5 illustrates placement of an encoder pattern or grating onto a CD-R recordable media, which encoder pattern or grating may be used to determine the instantaneous angular position of such CD-R recordable media in accordance with a third embodiment of the present invention.
Figure 7:
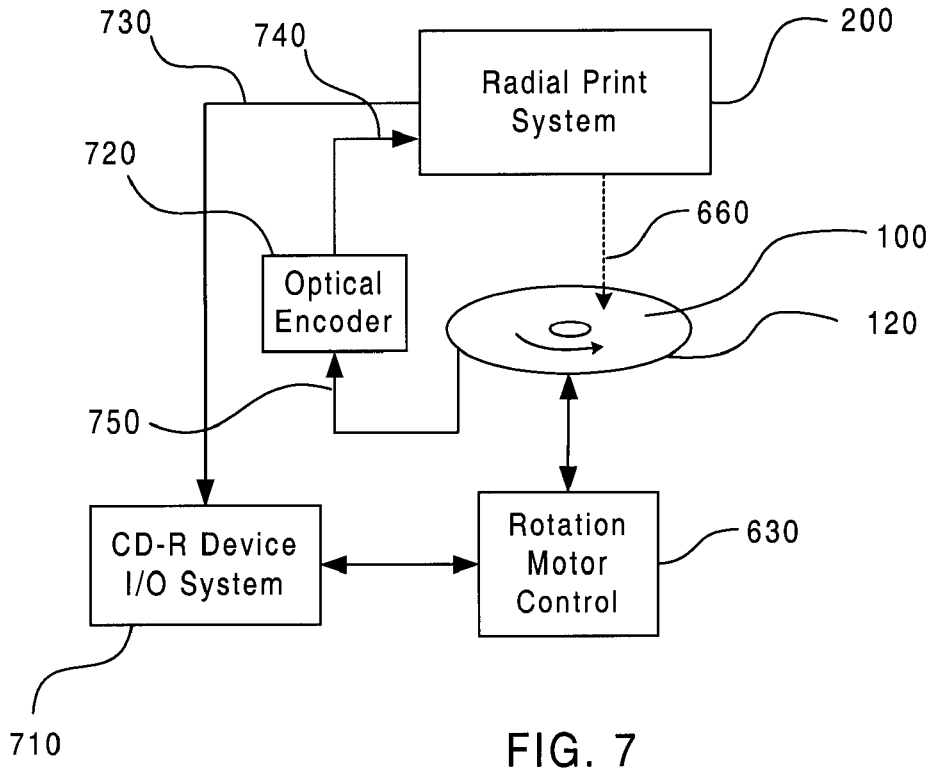
FIG. 7 is a diagrammatic illustration of a CD-R/printing system which utilizes a custom encoder pattern or grating on the CD-R recordable media to print onto such media in accordance with an example implementation of the third embodiment of the present invention.

In a third embodiment, illustrated in FIG. 1 and in the block diagram in FIG. 7, the recordable CD media is manufactured with a unique design to include an explicit encoder pattern or grating directly on the inner hub 110 or outer 120 circumference edge of the media, similar to the functions of a traditional encoder wheel. The grating pattern 110 or 120 is positioned just prior to or after the preformatted CD-R data area as shown in FIG. 5 herein. In the application for a radial printing system (FIG. 2), an encoder sensor 130 is positioned over the respective inner 110 or outer 120 track to count and measure the angular position. Given adequate angular resolution 140, this information is used to precisely place printed material 660 onto the spinning disc media 100, independent of the disc spin rate. This method has the advantage of providing encoder positional information without the need for a separate, external encoder wheel or grating pattern, since it is already included in the CD-R media during manufacturing. It also has the advantage of providing necessary angular print information completely independent of and decoupled from the normal operations of the CD recording system. Since it automatically and independently senses the spin rate from the signal 750 and 740, the radial printing system only needs to command the CD motor 630 to spin an adequate number of revolutions to complete printing, should the CD recording or reading process complete prior to completing radial printing. This simplifies the device, since the CD motor 630 can be enabled through its standard interface 730 via software control rather than a custom hardware interface 610. Illustrations in FIG. 1, FIG. 5, and FIG. 7 show the potential locations for the encoder pattern according to this method, near either the inner hub or outer circumference, either on the bottom side or on the top side of the media. However, other placements, methods and embodiments for encoder patterns directly on CD-R media may be devised as the technology and evolving CD or circular media standards permit.

A zero synchronization mark widely known to and used by those skilled in the art is included in the encoder pattern 110/120 to reset the count with each rotation. A benefit of this new method is that it re-synchronizes the label position on a CD-RW media when reinserted. This method enables removing and later reinserting the media multiple times to include additional printed content to the top surface of the media, or in the case of rewritable media (CD-RW/DVD-RW) this would allow adding new printed label information as new data is rewritten to the media, without the need for recognizing a previously printed label pattern, as in the prior art Cutler, et al. For example, one application is adding new picture files to previously recorded CD-RW (rewritable) media; the original disc label was prepared and saved as a template; upon reinsertion, the user updates the label template adding extra label or identification to the CD and then prints it again with prefect registration.

In summary, this third embodiment shows how to include an optical or diffraction grating pattern directly on blank circular media, negating the need to add an external encoder grating pattern and enabling the new technology to be able to re-synchronize the label position on a CD when re-inserted.

Figure 8:
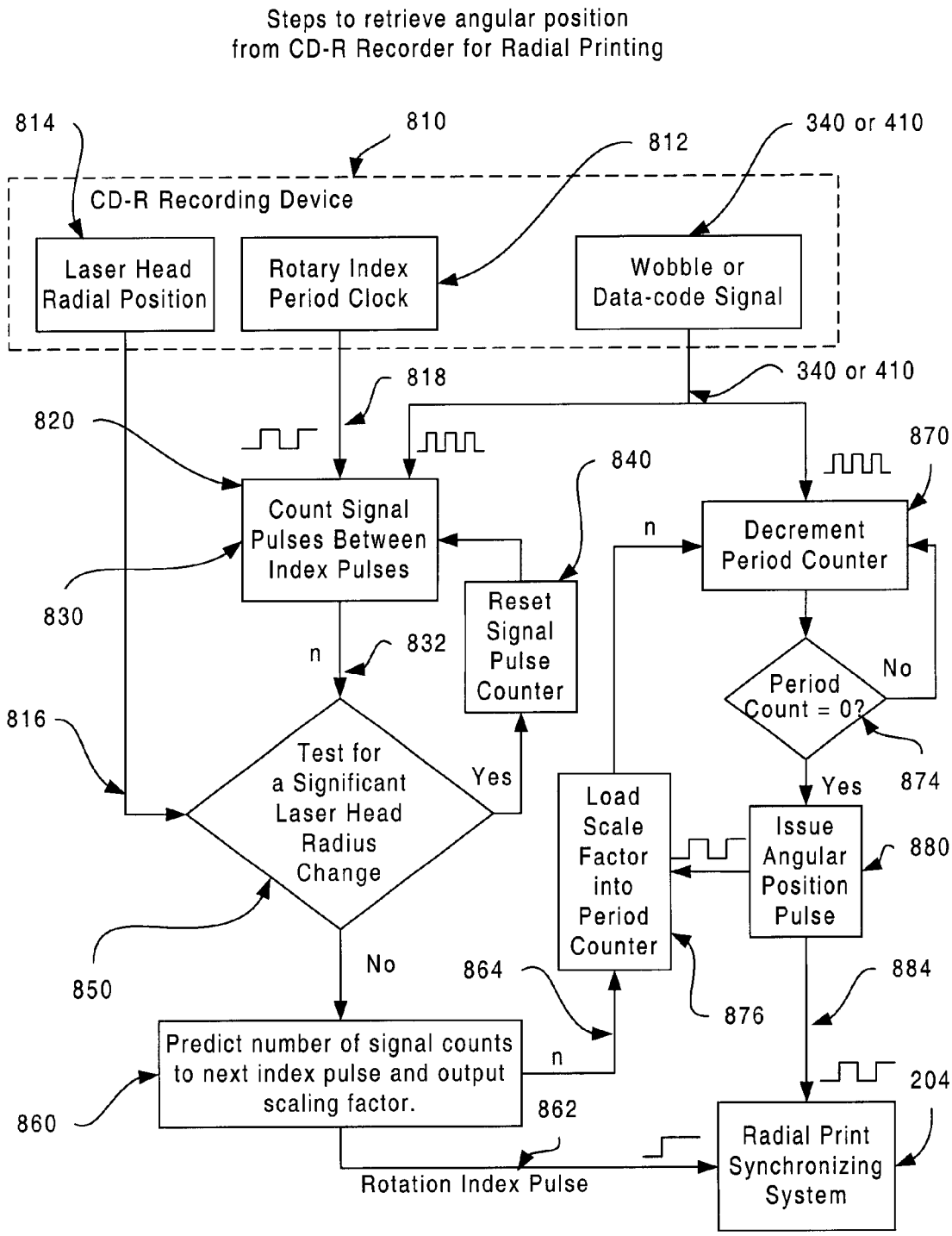
FIG. 8 is a flowchart illustrating a procedure for using the wobble or data-code signal from the CD-R recording device to print onto a rotating media in accordance with the first and second embodiments of the present invention.

The angular position 140 is derived from normal signals in the CD-R recording system. Referring to FIG. 8, three types of signals provide enough information with a sufficient accuracy and precision to determine angular position and thus enable radial printing: the wobble 340 or data-code 410 signals, the laser head radial position 816, and a rotary index period clock pulse 818. The latter, rotary index period clock pulse, can be generated in several ways, such as: a signal on the CD-R drive control system, the CD-R stepper motor pole positions, and external reference clock (separate component), or an external optical sensor determining the CD rotation (separate component). We anticipate other methods to acquire or fashion this rotary index period clock pulse; however, in general, this signal must be present to modulate the wobble or data-code signal.

In FIG. 8, the rotary index period pulses 818 may occur one or more times per revolution and at irregular positions; but for a given CD-R drive type, they will be at fixed and repeatable angular positions 140. The rotation index pulse 862 is derived from the rotary index period pulses 818 in such a way that only one pulse per revolution occurs.

The signal pulse counter 820 uses either the data-code signal pulses 410, or the wobble pulses 340, to determine the number of signal pulses 340/410 between the index pulses 818. Given the fixed relationship between angular position 140 of index pulses 818 and the current signal pulse count 340/410, a prediction is made for the number of signal pulses 340/410 that will occur per angular position 140 in the next region between index pulses. The prediction is converted into a scale factor 864 by dividing it by the number of angular positions per index region, based upon the geometry of the angular position 140.

Figure 9:
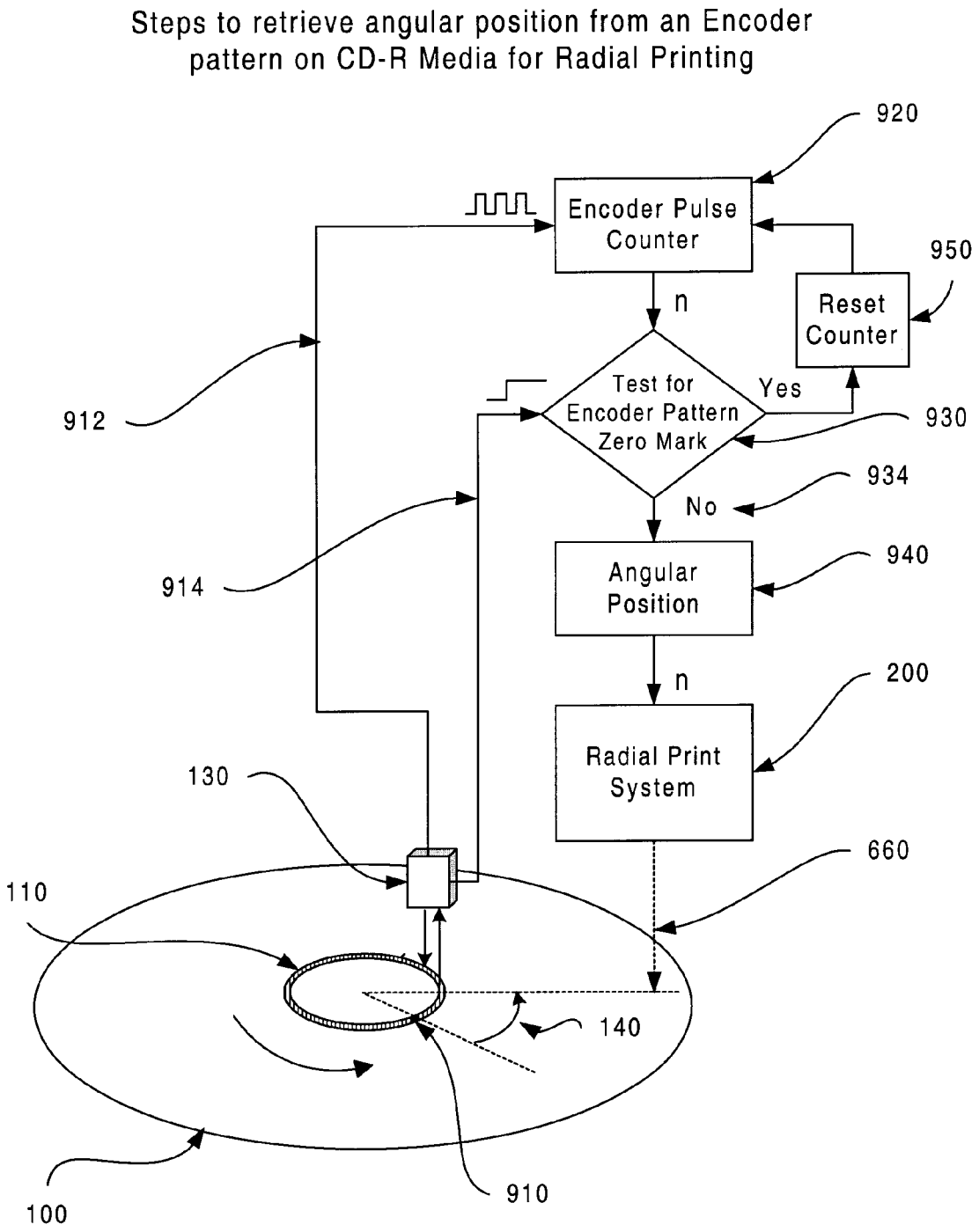
FIG. 9 is a flowchart illustrating a procedure for using a customer encoder pattern or grating on the CD-R recordable media to print onto such media in accordance with the third embodiment of the present invention.

Once the scale factor 864 is computed, it is used in a self-resetting period counter 870 to count down the number of signals per angular position 140. When the count reaches zero, the next rotationally sequenced angular position is been reached, and a signal equivalent to the encoder pulse FIG. 9, 912, is generated. The radial print synchronizing system 204 generates the angular position pulse 140 by counting angular position pulses 884 and then resetting the count with rotation index pulses 862, which is functionally equivalent to the zero mark synchronization pulse signals 914 in FIG. 9.

Another second method herein shows how to retrieve angular position 140 from an encoder pattern manufactured into the CD-R disc media for a radial printing system. Referring to FIG. 9, portions of FIG. 1 are shown under logic diagram, illustrating the placement of an optical encoder 130 over an encoder pattern on the inner hub 110. The encoded pattern 110 on the disc 100 contains two signal streams: higher-resolution pulses 912 counted by an encoder pulse counter 920 and secondly, a synchronizing zero pulse signal 914, which is tested by the zero mark logic 930 to determine when one rotation has occurred. If so, the Reset Counter 950 resets the Encoder Pulse Counter 920 to zero, to begin the start of the rotation count again. The "No" 934 logic test 930 results in a numeric value equivalent to the angular position 140. This in turn is used by the Radial Print System 200 directly to synchronize and coordinate print head and pen firing order 660 on the spinning disc 100.

We claim:

1. A method of printing onto a rotating media, comprising:

determining a reference angular position of the rotating media;

determining a current angular position of the rotating media based on timing information that is present within the rotating media, the timing information is selected from the group consisting of a plurality of pulses from a native wobble signal of the rotating media and a data-code signal associated with a data track of the rotating media, wherein the current angular position is determined relative to the reference angular position on the rotating media and accomplished by:

obtaining a rotary index signal from a recording device which is rotating the rotating media, the rotary index signal comprising one or more pulses generated at predefined angular positions within each revolution of the rotating media, wherein each revolution is divided into a predetermined number of angular positions;

determining a count of the pulses of the timing information between each pair of adjacent angular positions based on the rotary index signal and the predetermined number of angular positions, wherein the operation of determining the reference angular position is based on the rotary index signal;

issuing an angular position pulse for each count of the pulses of the timing information;

counting the angular position pulses to determine a current count of angular positions;

resetting the current count of angular position pulses at the reference angular position so that the current count of the angular position pulses is relative to a reference angular position; and defining the current angular position as the current count of the angular position pulses; and using the current angular position to accurately print an image onto the rotating media.

2. A method as recited in claim 1, wherein the count of the pulses of the timing information between each pair of adjacent angular positions is determined by:

determining a current count of pulses of the timing information between two current consecutive pulses of the rotary index signal;

predicting a next count of pulses of the timing information between a two next consecutive pulses of the rotary index signal based on the current count; and defining the count of the pulses of the timing information between each pair of adjacent angular positions as the predicted next count of pulses between the two next consecutive pulses of the rotary index signal divided by the number of angular positions between the two next consecutive pulses of the rotary index signal.

3. An apparatus for recording and printing onto a rotating media comprising:

a recording device operable to rotate the media and to record data onto the rotating media, wherein the recording device is further operable to provide a rotary index signal comprising one or more pulses generated at predefined angular positions within each revolution of the rotating media; and a radial printing system operable to:

determine a reference angular position of the rotating media;

determine a current angular position of the rotating media based on timing information that is present within the rotating media, the timing information is selected from the group consisting of a plurality of pulses from a native wobble signal of the rotating media and a data-code signal associated with a data track of the rotating media, wherein the current angular position is determined relative to the reference angular position on the rotating media and accomplished by:

dividing each revolution into a predetermined number of angular positions;

obtaining the rotary index signal from the recording device while it is rotating the rotating media;

determining a count of the pulses of the timing information between each pair of adjacent angular positions based on the rotary index signal and the predetermined number of angular positions, wherein the operation of determining the reference angular position is based on the rotary index signal;

issuing an angular position pulse for each count of the pulses of the timing information;

counting the angular position pulses to determine a current count of angular positions;

resetting the current count of angular position pulses at the reference angular position so that the current count of the angular position pulses is relative to a reference angular position; and defining the current angular position as the current count of the angular position pulses; and use the current angular position to accurately print an image onto the rotating media.

4. An apparatus as recited in claim 3, wherein the count of the pulses of the timing information between each pair of adjacent angular positions is determined by:

determining a current count of pulses of the timing information between two current consecutive pulses of the rotary index signal;

predicting a next count of pulses of the timing information between a two next consecutive pulses of the rotary index signal based on the current count; and defining the count of the pulses of the timing information between each pair of adjacent angular positions as the predicted next count of pulses between the two next consecutive pulses of the rotary index signal divided by the number of angular positions between the two next consecutive pulses of the rotary index signal.

5. A method of printing onto a rotating media, the method comprising:

with an encoder sensor, detecting a plurality of periodic structures of a encoding pattern on a rotating media as they pass near the encoder sensor and generating a encoder signal having a plurality of pulses that each correspond to a sensed periodic structure, wherein the encoding pattern has a predefined number of periodic structure that each correspond to an angular position on the media, the periodic structures being uniformly dispersed along a circular path that has a same center as the rotating media, and wherein a selected one of the periodic structures represents a reference angular position;

determining a current angular position of the rotating media relative to the reference angular position based on the encoder signal, wherein determining the current angular position of the rotating media is accomplished by:

counting the detected periodic structures to obtain a count of the detected periodic structures;

resetting the count when the periodic structure which corresponds to the reference angular position passes near the encoder sensor; and defining the current angular position as the count; and using the determined current angular position to accurately print an image onto the rotating media.

6. A method as recited in claim 5, wherein the encoder pattern is placed on an inner hub area or outer circumference area of the rotating media.

7. A method as recited in claim 6, wherein the encoder pattern is placed on a top surface or a bottom surface of the rotating media.

8. A method as recited in claim 5, wherein the encoder pattern is an optical or diffraction grating pattern.

9. An apparatus for recording and printing onto a rotating media comprising:

a recording device operable to rotate the media and to record onto the rotating media; and a radial printing system having an encoder sensor positionable over an encoder pattern on the rotating media, the radial printing device being operable to:

with the encoder sensor, detect the periodic structures of the encoding pattern as they pass near the encoder sensor and generate a encoder signal having a plurality of pulses that each correspond to a sensed periodic structure, the periodic structures being uniformly dispersed along a circular path that has a same center as the rotating media, and wherein a selected one of the periodic structures represents a reference angular position;

determine a current angular position of the rotating media relative to the reference angular position based on the encoder signal, wherein determining the current angular position of the rotating media is accomplished by:

counting the detected periodic structures to obtain a count of the detected periodic structures;

resetting the count when the periodic structure which corresponds to the reference angular position passes near the encoder sensor; and defining the current angular position as the count; and use the determined current angular position to accurately print an image onto the rotating media.

10. An apparatus as recited in claim 9, wherein the encoder pattern is placed on an inner hub area or outer circumference area of the rotating media.

11. An apparatus as recited in claim 10, wherein the encoder pattern is placed on a top surface or a bottom surface of the rotating media.

12. An apparatus as recited in claim 9, wherein the encoder pattern is an optical or diffraction grating pattern.

* * * * *